United States Patent [19]

Kaether

[11] 4,452,641

[45] Jun. 5, 1984

[54] METHOD FOR REDUCING THE LIQUID CONTENT OF SUGAR CANE BAGASSE

[76] Inventor: Willy Kaether, c/o BMA, P.O. Box 32 25, 33 Braunschweig, Fed. Rep. of Germany

[21] Appl. No.: 513,256

[22] Filed: Jul. 13, 1983

Related U.S. Application Data

[63] Continuation of Ser. No. 267,246, May 26, 1981, abandoned.

[30] Foreign Application Priority Data

Jun. 6, 1980 [DE] Fed. Rep. of Germany ..... 3021311

[51] Int. Cl.[3] ..... C13D 1/02

[52] U.S. Cl. ..... 127/43; 127/3; 127/5; 127/6; 100/37; 100/118; 100/121

[58] Field of Search ..... 127/42, 43, 45, 2, 3, 127/4, 5, 6; 100/70 A, 42, 37, 121, 118, 119, 120, 153

[56] References Cited

U.S. PATENT DOCUMENTS

| | | | |
|---|---|---|---|
| 3,501,345 | 3/1970 | Kaether et al. | 127/6 X |
| 3,629,002 | 12/1971 | Kaether et al. | 127/43 X |
| 3,697,324 | 10/1972 | Steele et al. | 127/4 X |
| 4,043,832 | 8/1977 | Leibig et al. | 127/43 X |

FOREIGN PATENT DOCUMENTS

| | | | |
|---|---|---|---|
| 1567245 | 6/1970 | Fed. Rep. of Germany . | |
| 2738919 | 3/1978 | Fed. Rep. of Germany | 100/121 |
| 2657232 | 6/1978 | Fed. Rep. of Germany . | |
| 2716666 | 10/1978 | Fed. Rep. of Germany . | |
| 2819719 | 11/1979 | Fed. Rep. of Germany | 127/3 |

OTHER PUBLICATIONS

Noell Deer, "Relation Between Pressure and Compression" Handbook of Cane Sugar Engineering by E. Hugot Second, completely revised, Edition Elsevier Publishing Company, Amsterdam, 1972, p. 147.

*Primary Examiner*—Kenneth M. Schor

*Attorney, Agent, or Firm*—W. G. Fasse; D. H. Kane, Jr.

[57] ABSTRACT

The liquid content of sugar cane bagasse is reduced by a low pressure process having a substantially longer duration than the duration of prior art high pressure liquid removal processes. For this purpose the liquid containing bagasse, as it emerges from a diffuser, is exposed to a relatively slowly increasing yet low pressure as compared to prior art high pressures, whereby the bagasse travels with a substantially constant speed sequentially through a dewatering zone, wherein a further compaction takes place, a preliminary squeeze-out zone and a final squeeze-out zone. During the preliminary squeeze-out the pressure above an open surface area or section without a sieve or screen is about 0.2 kg/cm$^2$. During the final squeeze-out the pressure (p) is about $p/0.6D > 0.003$, wherein D is the diameter, in mm, of a squeeze-out roller. The pressing duration t in seconds is also related to the squeeze-out roller diameter D such that D:t is smaller than a constant value K 16. The preliminary or initial squeeze-out may comprise two portions of which the first portion is initiated by a compacting roller.

12 Claims, 3 Drawing Figures

METHOD FOR REDUCING THE LIQUID CONTENT OF SUGAR CANE BAGASSE

This is a file wrapper continuation of application Ser. No.: 267,246 filed: May 26, 1981 and now abandoned.

CROSS-REFERENCE TO RELATED APPLICATION

The present invention is based on German Patent application No. P 3,021,311.7, filed in the Federal Republic of Germany on June 6, 1980. The priority of the German filing date is claimed for the present application.

BACKGROUND OF THE INVENTION

The present invention relates to a method and apparatus for reducing the liquid content of sugar cane bagasse as it emerges, for example, from a sugar cane diffuser comprising a linear or circular diffuser construction. Such a diffuser may be equipped with a stationary or with a movable screen bottom as is well known in the art, see for example, German Pat. No. 1,567,245.

The just mentioned German Pat. No. 1,567,245 discloses the use of three cylinder high pressure mills arranged downstream of a diffuser as viewed in he feed advance direction of the bagasse. Such high pressure mills reduce the moisture content of bagasse to a remaining moisture content of about 50 to 52% by weight at a substantial expense for the original equipment investment as well as for the power requirements for operating such high pressure mills.

Referring first to FIG. 4 representing the prior art as disclosed in German Patent No. 1,567,245 such a prior art system comprises a diffuser 20 followed by one or several high pressure mills 30. The bagasse B travels through a diffuser output trough 25 having a bottom 21 formed by a screen type conveyor belt 22 feeding the bagasse B toward a peeling drum 28 which simultaneously forms a closure cylinder or roller at the end of the diffuser output trough 25. The peeling or closing drum 28 is located above an unperforated bottom portion 21' of the trough 25. The unperforated bottom portion 21' is located just downstream of a guide roller 24 over which the conveyor belt 22 travels. A juice collecting trough 23 is arranged below the upper run of the conveyor belt 22. A so-called pendulum roller or cylinder 26 is supported by lever arm 27 and provides a preliminary compaction of the bagasse B above the screen bottom 21 for a preliminary dewatering.

The closing and peeling roller 28 feeds the partially dewatered bagasse onto a conveyor 29 which in turn supplies the bagasse into the first high pressure roller mill 30. The output of the first roller mill 30 is supplied to a conveyor 37 which in turn feeds the further dewatered bagasse into the second high pressure roller mill 30. Both high pressure roller mills are of the same construction and therefore the same elements are designated by the same reference numbers and only the first mill will be described. Each mill has a housing 31 supporting two lower cylinder cores or shafts 32 surrounded by high quality steel jackets 33 and separated by a so-called bagasse bar 34. A further upper roller core 35 is also supported in the housing 31 and surrounded by a high quality steel jacket 36.

The pendulum roller 26 forming part of the diffuser 20 causes a preliminary dewatering. The further dewatering of liquid removal is then accomplished sequentially in the high pressure three roller mills 30. The disadvantages of such mills are well known. For example, the roller jackets 33 and 36 have an outer diameter up to 1000 mm and are made of a special casting alloy. The roller cores or axles 32 and 35 must also be made of high strength steel and the shrinking of the jackets onto the cores or axles is also a costly operation. Due to the high pressures involved ranging to approximately 1000 kg/cm$^2$, the roller jackets and also the cores are subject to high wear and tear so that repairs or a complete exchange is necessary from time to time. Heretofore sugar factories have been equipped with special repair shops for the set up and maintenance of these high pressure mills in order to minimize dead times necessitated by such maintenance and exchange work.

Further, counting the pendulum roller 26, systems of the prior art as disclosed in the above mentioned German Pat. No. 1,567,245, require a total of seven rollers of which the six rollers in the two mills must be made of the mentioned special steel alloys in order to withstand the high pressures in the order of 1000 kg/cm$^2$.

Another disadvantage of prior art three roller high pressure mills is seen in that their structure inherently requires the so-called bagasse bar 34 which separates the two lower rollers 32, 33, however, which is without any effect for the liquid removal for all practical purposes. At the same time, these bagasse bars substantially increase the required power input for driving these mills because of the large frictional sliding forces of the bagasse along these bars 34. Thus, it is known that the driving powers for each of these mills requires approximately 1000 PS (horsepower). Additionally, the initial investment of capital for these high power drive means with the required reduction gears are quite substantial. For example, where the prime mover is a steam turbine, the gear reduction ratio may be 1 to 2500 and more.

The advances which have been made over the past 50 years in the development of three roller high pressure mills for the squeezing-out of sugar cane bagasse related primarily to the ever increasing roller pressures. Today such pressures have reached values of about 1000 kg/cm$^2$ between the rollers as mentioned. More recent developments go even further in this wrong direction in that five roller high pressure mills have been built as over-dimensioned blocks again operating with pressures of about 1000 kg/cm$^2$.

A theoretical investigation regarding the internal pressure and time lapse functions in a three roller high pressure mill of conventional construction has been made taking into account the above mentioned 1000 kg/cm$^2$ pressures between the rollers. Such theoretical investigation has taken into account the compression characteristics of sugar cane bagasse according to the publication by Noel Deer entitled "Relation Between Pressure and Compression" published by Elsevier Publishing Comp., Amsterdam, 1972 (147). As a result of said theoretical investigation the conclusion has been reached that these high pressures between the rollers are quite without effect in such three roller high pressure mills due to the pressure and lapse of time functions in the order of merely 100ths of seconds in the upper pressure rise range.

The numerically important result of said theoretical investigation is seen in that in conventional high pressure mills having a customary circumferential roller speed of, for example, 25 cm/s the time available for the rise of the roller pressure from 49.4 kg/cm$^2$ to 727 kg/cm$^2$ is only 5/100 s. This figure applies to a roller diameter of 800 mm. As a matter of fact, for a rise in the pressure from 83.9 to 727 kg/cm$^2$ the available time is only 1.6/100 s. Such a short time is insufficient to achieve an efficient squeezing-out of all structural components of the sugar cane bagasse because of the widely varying hardness of the bagasse components and because of the wide variations in the structure of the sugar cane bagasse. It has been found that the high compressions employed today in three roller high pressure mills are not effective for the squeezing-out, but are rather converted into heat during the short available time periods. The inefficiency of such high pressures is further evidenced externally by the well known loud and clearly audible sporadic so-called juice shots which sound like an explosion and which are evidence of the non-uniform, uneconomical, and substantially inefficient squeezing-off operation in prior art high pressure mills.

The theoretical considerations have further shown that the high pressures result in a large increase in the hardening of the sugar cane bagasse whereby the required remaining moisture content cannot be achieved by the substantially instantaneously established maximum pressure which is reached in a matter of a few hundredths of a second.

The preliminary dewatering in a system as shown in FIG. 4 is accomplished by means of the pendulum roller 26 which simultaneously operates as a trough closing roller. The roller 26 has a diameter of 3 to 4 m. Such a roller 26 operating as a dewatering roller and as a trough end closing roller may be operated only with pressures of approximately 1.0 kg/cm$^2$ because even these low pressures result in very large, hardly controllable frictional forces due to the large roller diameter and due to the respectively large pressure application surface area. Additional friction forces are caused, for example, in a linear diffuser trough by the stationary screen bottom which is equipped with chains which transport the bagasse through the diffuser trough by means of entraining rods. Several such chains are necessary in each diffuser and the loads effective in each of these several chains which transport the bagasse into the diffuser amount to approximately 35,000 kg. Approximately 30% of these forces are caused alone by the friction of the roller 26 even at the mentioned low pressure. The sum of all the chain forces in a diffuser having, for example, a 4000 ton sugar cane capacity per day amounts to 200 tons and more. Such chains cost approximately $225,000.00 and the total price of a conventional diffuser amounts to approximately 1.15 million dollars not counting the high pressure mills, each of which costs approximately also 1.15 million dollars. These figures show the large economic importance in the reduction of the chain forces by avoiding the prior art type dewatering in the diffuser itself above the diffuser screen bottom as described in the above mentioned German Pat. No. 1,567,245. The large chain strength required according to the prior art also cause a very heavy overall construction because the chain guide rollers, the chain drives, and the chain gear system all must be constructed with due regard to these large chain forces. The invention aims at avoiding such large chain strengths. German Patent Publications Nos. 2,657,232 and 2,716,666 as well as 2,819,719 disclose efforts in improving the low pressure preliminary dewatering in a diffuser by means of a roller such as shown at 26 in FIG. 4. Such improvements involve the use of differently shaped screen surfaces which may be placed at different elevational positions in a roof type sequential arrangement. Such additional screen surfaces may also be bent into the desired shape. These arrangements have increased the effectiveness of the preliminary dewatering of the bagasse prior to its final squeeze-out in the following high pressure mills. However, one overriding disadvantage of such additional screen surfaces is seen in that they even increase the frictional forces as compared to the roller 26 disclosed in German Pat. No. 1,567,245. Although these additional screen surfaces result in a desirable relief of the final high pressure squeeze-out in the three roller high pressure mills, the costs for these additional devices are out of proportion to their advantages.

OBJECTS OF THE INVENTION

In view of the foregoing it is the aim of the invention to achieve the following objects singly of in combination:

- to provide a method and apparatus for the liquid removal of sugar cane bagasse to an extent which provides a desirable remaining moisture content by applying a minimal squeezing-out compression during relatively long time periods;
- to apply, for the liquid removal from sugar cane bagasse, three sequentially increasing pressures or compressions such that even the largest pressure does not exceed about 2 to 20% of the pressure or compressions employed heretofore in so-called high pressure mills;
- to achieve substantial economic advantages as compared to the prior art with regard to the required initial capital investment and also with regard to the maintenance and power requirements for the operation of a liquid removal system according to the invention;
- to employ, following a preliminary dewatering, an intermediate or preliminary squeezing-out step prior to a final squeezing-out step, whereby the intermediate or preliminary squeezing-out step takes place in the portion of the bagasse stream or flow above an open, screenless surface area;
- to employ a so-called low pressure liquid reduction method or process for achieving the same or even a better remaining moisture content in the sugar cane bagasse;
- to increase the pressure or compression application time to approximately seventy times that of the durations of pressure application used heretofore;
- to substantially reduce the number of components in an apparatus according to the invention, especially to reduce the number of compression applying rollers as compared to the prior art;
- to avoid the need for using high alloy steels in the compression rollers; and
- to utilize the apparatus components or at least certain apparatus components so that they perform a plurality of different functions simultaneously.

SUMMARY OF THE INVENTION

According to the invention the present method and apparatus are characterized by very low compression values which range up to merely 24 kg/cm$^2$ amounting to 2.4% of the compressions used in the prior art as described above such as the customary three roller or cylinder high pressure mills, whereby the invention achieves simultaneously a remaining moisture content which is equal or even better than that achieved heretofore. The invention is further characterized by a substantial increase in the time for the pressure application, for example, up to 70 times the pressure durations of the prior art. Basically, the present invention employs three steps, a preliminary, partial dewatering followed by a final squeezing-out step which in turn is followed by a final squeezing-out step. The preliminary dewatering step takes place preferably at a pressure of about 0.08 $kg/cm^2$. The preliminary squeezing-out or intermediate step takes place above an open, screenless surface section in the feed advance path of the bagasse, whereby the average or mean compression during the preliminary squeezing-out corresponds to about 0.2 $kg/cm^2$. The final squeezing-out compression takes place between two curved surfaces preferably including at least one squeezing roller having a diameter D in mm and exerting a compression p satisfying the condition that p/0.6D is larger than 0.003. Further, the time t during which the compression is applied is also related to the roller diameter to satisfy the condition that D/t is a constant k value 16. In the present method the applied pressure increases gradually and relatively slowly from step to step or zone to zone, while the bagasse moves simultaneously in the feed advance direction in such a manner that the particles of the bagasse are displaced relative to one another in the feed advance direction. In spite of this displacement of the bagasse particles, the compactness of the entire bagasse stream is maintained and the liquid squeezing-out operation continues without interruption.

It has been found that the preliminary dewatering and especially also the intermediate or preliminary squeezing-out above the open screenless surface area make it possible to discharge or remove the relatively large liquid flow even without lateral sieves or screens in the diffuser, or rather, in the trough through which the bagasse travels.

The preliminary squeezing-out or intermediate step has been made possible according to the invention by the staggering arrangement of the squeezing-out roller relative to a lower counter surface which may also be a roller operating as a counter roller of which may be a surface operating as a counter surface, and relative to the location of an open screenless surface area or section in the feed advance path of the bagasse. This preliminary squeezing-out or intermediate step has been further made possible by correlating the diameter of the squeezing out roller to the time during which the pressure application takes place and by further correlation of the squeezing out roller diameter to the height of the bagasse flow as will be described in more detail below.

The upper squeezing-out roller may also cooperate with a screen surface which is substantially plane toward its downstream end and which is somewhat curved toward its upstream end as viewed in the flow direction of the bagasse. The curvature of the stationary screen counter surface reduces the frictional forces caused by the squeezing-out upper roller because its arrangement is such that only approximately one half of the counter pressure screen surface is exposed to the pressure exerted by the squeezing-out roller.

It is an advantage of the invention that the undisturbed bagasse flow as it exits from the diffusion is used directly and undisturbed in its substantial consistency or rather density, whereby a peeling roller as required in the prior art has been obviated according to the invention. Further, intermediate conveyor belts and similar equipment which is required in a three roller high pressure mill has been obviated according to the invention by the surprisingly simple use of two surfaces cooperating with each other in the application of the squeezing out compression by oppositely directed curvatures. The above mentioned staggering of the upper compression or squeezing-out roller makes it possible that the bagasse flow does not break up at its lower side when it is travelling over the open screenless surface section between the end of the screen conveyor in the bagasse feed advance trough and the lower roller or counter holder surface. This maintaining of the compactness of the bagasse flow, in other words, the avoidance of a breaking up of the bagasse flow above the open, screenless zone or area is apparently accomplished according to the invention by the bending of the bagasse flow above this zone so that the bagasse portions adjacent to the open screenless zone are exposed to a compression along the lower side of the bagasse flow passing over the open screenless zone.

By reducing the compressions according to the invention to values in the range of about 2 to 20% of the pressures necessary heretofore and by correlating the roller diameters to the applied pressures and to the depth of the bagasse the invention has achieved substantial advantages which well outweigh the substantially increased duration of the pressure application. Thus, where the invention employs only about 2.4% of the prior art pressures of 1000 $kg/cm^2$, the invention achieves a better that is lower remaining moisture content than was possible according to the prior art. Even more important, this result has been achieved by an apparaatus which is substantially simpler than prior art systems of the three roller high pressure type. The simpler apparatus is also less expensive.

The apparatus according to the invention may be connected in series with a conventional diffuser or it may be directly incorporated as an integral part of the diffuser system. Further, several stages may be connected in series while still achieving substantial economic advantages over prior art systems.

The apparatus according to the invention comprises a bagasse feed advance path including feed advance means as a conveyor with entraining rods and a screen support forming the bottom in the feed advance path. An open screenless section is located in the feed advance path and preliminary compacting means such as a roller are arranged in the feed advance path adjacent to, but still upstream of the open screenless section. Preferably, the preliminary compacting roller is arranged substantially above a smooth unperforated end portion of the bottom of the feed advance path. This unperforated end portion is located just upstream of the open, screenless section or portion. The preliminary compacting roller provides a first zone in which a preliminary liquid removal or dewatering of the bagasse takes place. Squeezing pressure application means such as two rollers or a roller and a counter pressure member are arranged downstream of the first zone and relative to the open, screenless section in such a manner that the two cooperating, oppositely curved surfaces form a second zone substantially above the open, screenless section for increasing the pressure on the bagasse to perform a preliminary squeezing-out operation. The two cooperating pressure applying surfaces also form a third zone for further increasing the squeezing-out pressure on the bagasse. The three zones are located in sequence along the feed advance path for providing three pressure application stages or zones with successively increasing, yet substantially low pressures which are applied in a relatively slow fashion as compared to the prior art, whereby the bagasse particles are shifted relative to one another in the feed advance direction and the compactness of an advancing bagasse flow is maintained while the sequeezing continues even over the open, screenless section.

BRIEF FIGURE DESCRIPTION

In order that the invention may be clearly understood, it will now be described, by way of example, with reference to the accompanying drawings, wherein.

Figure 1:
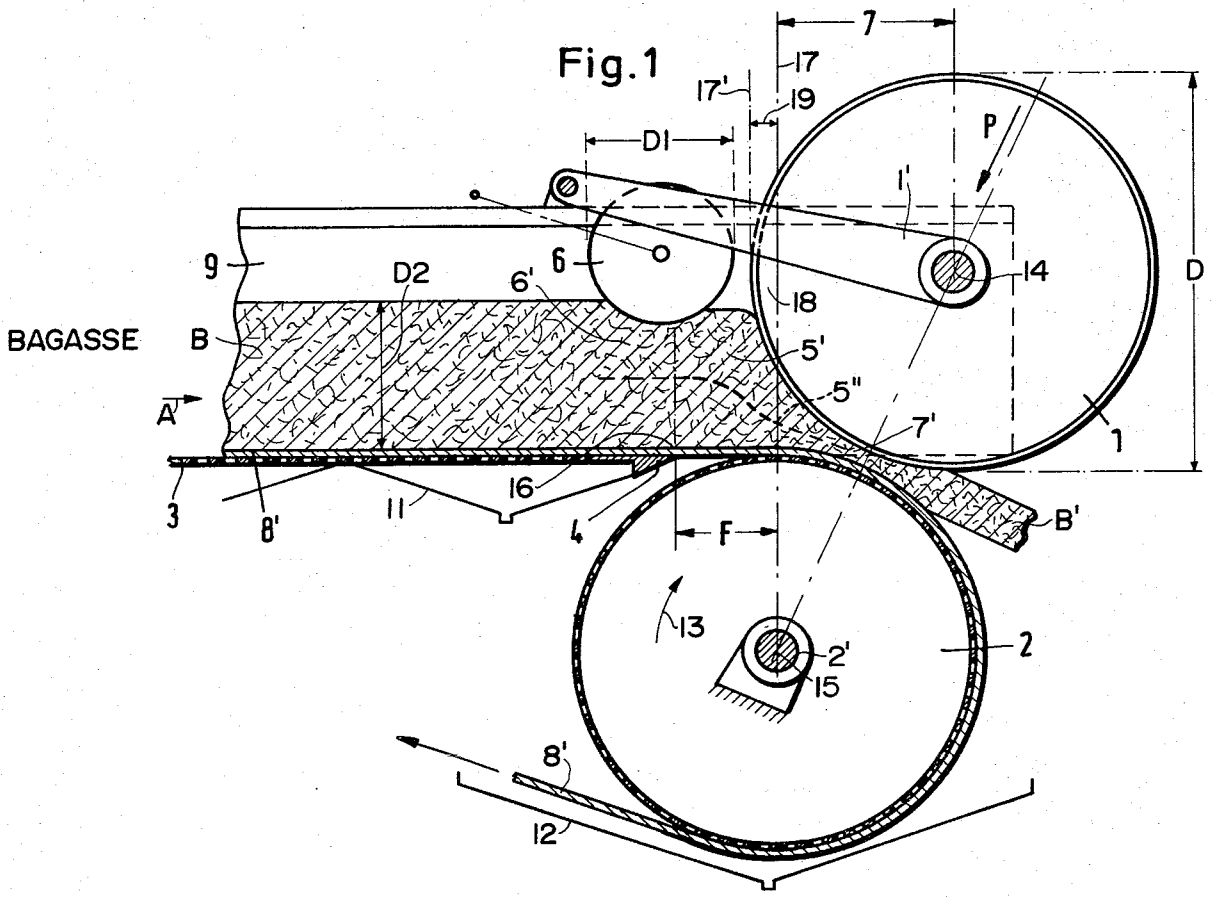
FIG. 1 is a sectional view through an apparatus according to the invention constructed so as to be suitable for incorporation as an integral part of a conventional sugar cane bagasse diffuser, whereby a counter pressure roller simultaneously provides a guide roller for the liquid permeable, screen type conveyor belt.

DETAILED DESCRIPTION OF PREFERRED EXAMPLE EMBODIMENTS AND OF THE BEST MODE OF THE INVENTION:

In FIG. 1 the bagasse B advances through a feed advance path 9 in the direction of the arrow A. The meaning of "upstream" and "downstream" in this context will be with reference to the feed advance direction A. The bagasse coming from a diffuser, not shown, travels with a substantially constant feed advance speed into a liquid reducing apparatus in which the speed corresponds approximately to the exit speed of the bagasse from the diffuser.

The bagasse B has a depth D2 above a liquid permeable conveyor belt 8' which is supported by a staationary screen bottom 3 above liquid collector troughs 11. The screen bottom 3 has a nonperforated end member 4 with a smooth upwardly facing surface 16. The conveyor belt 8' is guided around a screen drum 2 supported by a shaft 2' having a rotational axis 15. A liquid collecting trough 12 is located below the screen drum 2 which rotates in the direction of the arrow 13.

According to the invention an open screenless section or surface area F is provided in the bottom of the feed advance path 9 between the downstream end of the end member 4 and a vertical line 17 extending through the rotational axis 15 of the drum 2. The purpose and function of this open, screenless section F will be described in more detail below. Section F has a length L in the direction A.

A preliminary compacting means such as a roller 6 is located substantially above the smooth surface 16 of the end member 4 and just upstream of the bottom section F. The roller 6 may be supported in the pendulum manner and forms a first zone 6' having a first given length in which the bagasse B is further compacted and subjected to a preliminary liquid removal or dewatering. The roller 6 has a diameter D1 to be described below.

A compression roller or cylinder 1 having a diameter D is arranged downstream and in staggered relationship relative to the screen drum 2 acting as a counter roller. The compression roller or cylinder is supported by pendulum arms 1' permitting a rotational, pendulum movement of the cylinder or roller 1 to exert a compression p. The roller 1 is staggered relative to the roller 2 by a horizontal spacing 7 between the rotational axis 14 of the roller 1 and the rotational axis 15 of the roller 2. This spacing 7 is selected so that a vertical segment 18 cut-off by the vertical line 17, thus forming a chord line, reaches to an extent 19 into the space above the open, screenless bottom section F. A second zone 5' is formed above the section F in which the bagasse flow is bent downwardly for a preliminary squeeze-out operation to be described in more detail below. The second zone 5' also has a given length corresponding to section F. The two rollers 1 and 2 form a funnel shape, the narrowing end of which constitutes a third zone 7' of given length in which the compression is further increased and from which the dewatered bagasse B' emerges as shown. A dashed line 5'' runs through all three zones 6', 5', and 7' and indicates the continuous, sequential cooperation between these three zones 6', 5', 7'.

Figure 2:
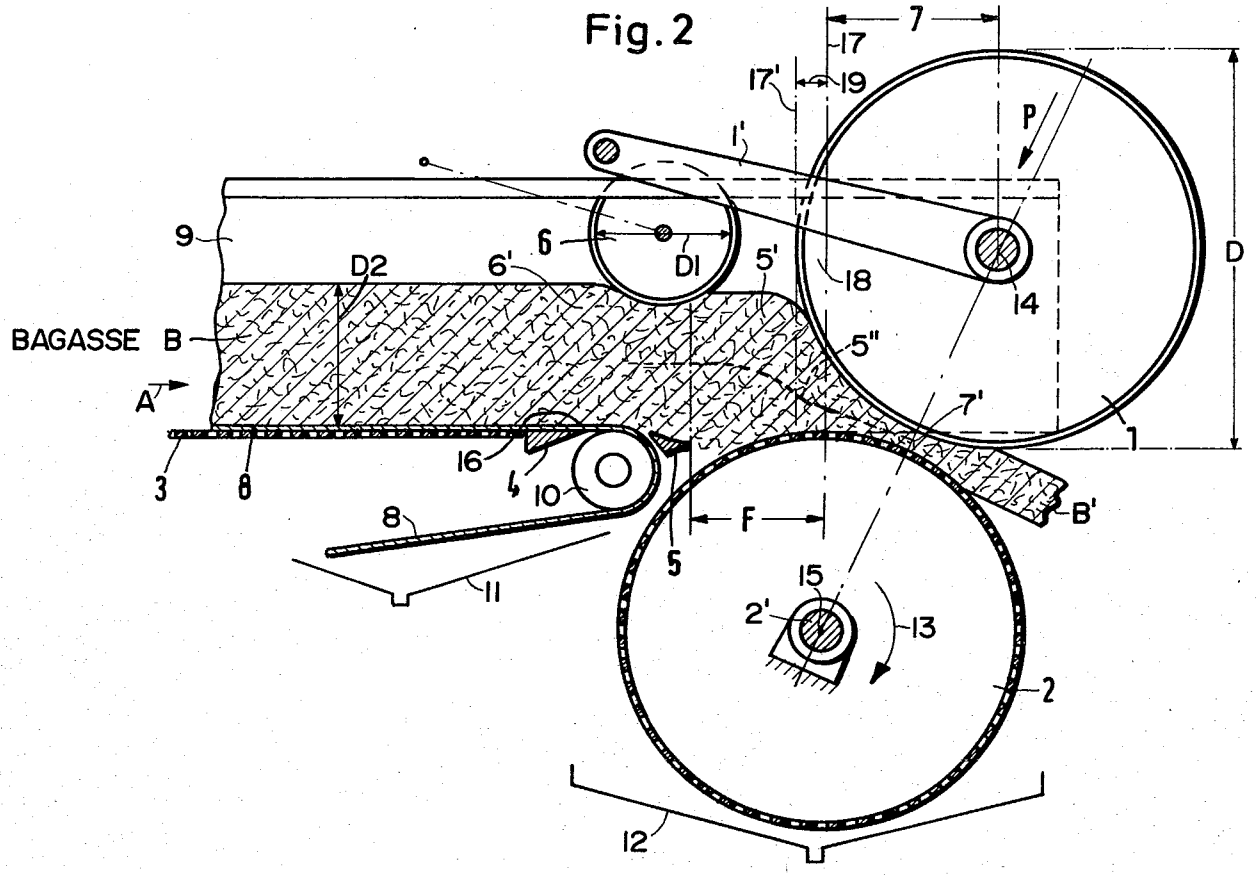
FIG. 2 is a view similar to that of FIG. 1, however, showing a separate guide roller for the feed advance conveyor.

FIG. 2 shows a structure similar to that of FIG. 1, however, in FIG. 2 the screen roller 2 acting as a counter pressure roller does not guide the conveyor belt 8. The conveyor belt 8 in FIG. 2 runs around a guide roller 10. Between the guide roller 10 and the open, screenless section F there is arranged a guide bar 5 having a smooth upwardly facing surface below the roller 6. In FIG. 2 the vertical segment 18 between the vertical chord line 17 and the vertical tangent 17' to the roller 1 also reaches into the space above the open, screenless section F. The further details in FIG. 2 are the same as in FIG. 1.

The basic theoretical investigations mentioned above caused making a number of substantial tests in a sugar cane factory. Such tests have shown that a system constructed in accordance with the invention as shown in FIGS. 1 or 2 provides substantial advantages. For example, if the pressure p corresponds merely to 2.4% of the conventional pressure of approximately 1000 kg/cm$^2$, the apparatus according to the invention achieves the same or even a smaller remaining moisture content in percent by weight. The following table compares the test results for an apparatus of the invention with the conventional three roller high pressure mill.

| | Low Pressure System of the Invention | Conventional 3-Roller-High Pressure Mill |
|---|---|---|
| maximal compression | 24 kg/cm$^2$ | 1000 kg/cm$^2$ |
| % of maximal compression | 2.4% | 100% |
| Duration of Pressure Application | about 40 seconds | 0.6 sec. |
| Remaining Moisture content (% by weight) | 48–50% | 50–51% |

Figure 3:
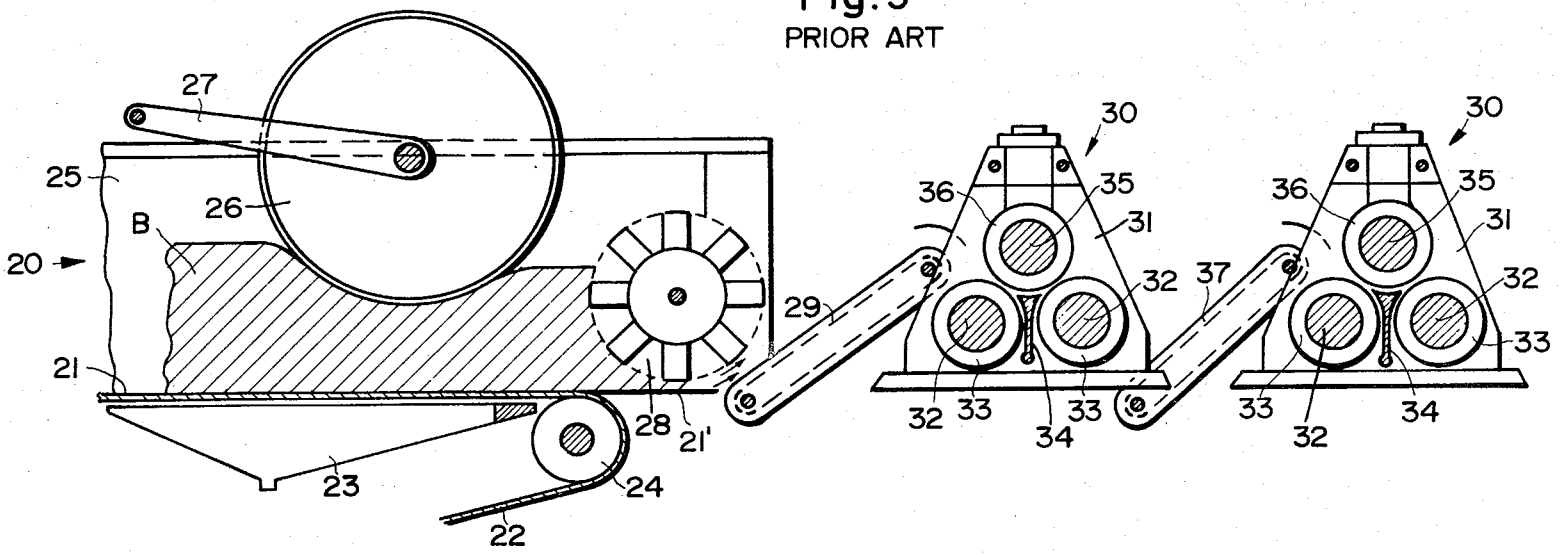
Fig. 3 PRIOR ART
FIG. 3 shows a sectional side view of a prior art system which has been described above in detail.

As compared to a prior art mill shown in FIG. 3, the invention achieves substantial economic advantages, particularly in two areas. First, a system according to the invention requires substantially lower initial investment capital. Second, the operation and maintenance costs for a system of the invention are also substantially lower while simultaneously achieving an even better remainder moisture content in the bagasse B' as it emerges from an apparatus according to the invention. Thus, not counting the investment costs for the diffuser which is the same in a system according to the invention and in a prior art system, a single mill as shown in FIG. 3 with its drive means, its intermediate conveyor systems and pumps costs approximately 1.15 million dollars when the mill has a capacity of 4000 tons per day. Thus, since at least two high pressure mills are required, the investments costs would be 2.3 million dollars. Contrary thereto a system according to the invention costs approximately 0.65 million dollars. This is a surprising advantage, particularly if one takes into consideration that the remaining moisture content according to the invention is even improved over that achievable by two high pressure mills arranged in sequence as shown in FIG. 3. The remaining moisture content in the prior art is approximately 50 to 52%, whereas according to the invention it is about 48 to 50%. Further, if one takes into account a daily capacity of 4000 tons of sugar cane for a campaign duration of 150 days, the energy savings involve approximately 900 tons of fuel oil. This is a substantial saving having regard to the ever increasing fuel oil costs. Further, due to the low pressure operation according to the invention the required input power has been reduced by 32% as compared to the prior art input requirement for a mill as shown in FIG. 3 which requires a power input installation of about 2600 horsepower, whereas the apparatus according to the invention requires only 860 horsepower.

The structural details and operation of an apparatus according to the invention will now be described. The first zone 6' for the preliminary dewatering is formed primarily below the roller 6 and above the upwardly facing surface 16 of the bottom end member 4 and a guide member 5.

The intermediate zone 5' for a preliminary squeezing-out operation is formed above the open, screenless section F. The roller 6 reaches partially into the zone 5' in the downstream direction. The roller 1 reaches partially into the zone 5' in the upstream direction. The zone 7' for the final squeezing-out operation is formed between the two rollers 1 and 2 or between the roller 1 and the counter pressure member 3'. The preliminary dewatering of the bagasse prior to an initial squeezing out operation followed by a final squeezing-out operation is important. However, performing the prelimimary dewatering in the diffuser itself as described above with reference to the prior art has substantial disadvantages due to the arrangement of the pendulum roller or cylinder 26 in the diffuser as disclosed in said German Patent No. 1,567,245 because of the large frictional forces on the surface of the screen bottom of the diffuser discharge trough. Due to the perforations in the screen bottom the friction coefficient $\mu$ may correspond to 1.0 for compression values of merely 1 kg/cm$^2$. The invention recognizes that it is essential to reduce or avoid the resulting friction losses.

The invention achieves this objective by the features of the zone 6' in which the roller 6 performs a triple function. First, the roller 6 equalizes or levels the surface of the bagasse flow B thereby slightly compacting the bagasse prior to the initial and final pressing out operation of the bagasse. Second, the roller 6 causes the dewatering at a low pressure of preferably about 0.08 kg/cm$^2$ above the smooth surface portion 16 which is unperforated and forms the end of the discharge trough bottom ahead of the open section F. Third, the roller 6 performs a first portion of the initial squeezing out operation above the open screenless section F, whereby the pressure increases slowly to a preferable value of about 0.3 kg/cm$^2$. Due to the open, screenless section F and due to the controlled slow rising of the pressure in this zone the invention assures a positive removal of the large liquid quantity becoming available in this area. The preliminary dewatering takes place outside the screen bottom above the smooth surface 16 having a friction coefficient $\mu$ of about 0.15 which is a substantial reduction relative to the above mentioned friction value of 1.0 for the arrangement of German Patent No. 1,567,245. The guide roller 10 in FIGS. 2 and 3 or rather the conveyor belt 8 running over this guide roller 10 also provides a relatively smooth surface and so does the intermediate member or guide 5.

In order to achieve the above triple function of the roller 6 with the mentioned low pressures it is important that the roller 6 is positioned as described relative to the smooth surface 16 and relative to the section F. Additionally, the roller 6 should be dimensioned so that its diameter D1 in its relation to the depth D2 of the bagasse prior to its exposure to the roller 6 should satisfy the following condition D1/D2 should be smaller than or equal to 1.25.

The open, screenless section F according to the invention is important for the formation of the zone 5' in which an intial or preliminary squeezing-out takes place at a pressure of preferably 0.2 kg/cm$^2$. In FIGS. 1 and 2 the downstream end of the section F is defined by the highest point of the lower roller 2 through which the vertical chord line 17 extends. In the zone 5' above the section F the bagasse is bent downwardly so that compression forces are effective in the lower layer of the bagasse flow, whereby the latter remains intact when it passes through the zone F even though it is not supported in this zone. This bending is accomplished due to the horizontal staggering 7 between the axis 14 of the roller 1 and the axis 15 of the roller 2. Thus, it is possible to move the bagasse without any support at all through the secton F, whereby in FIGS. 1 and 2 the lower roller 2 takes over the further feed advance of the bagasse into the zone 7'. Simultaneously, the feed advance by the conveyor belts 8 or 8' continues. Incidentally, the smooth transition of the dewatering, initial squeezing or final squeezing operations one into the next is indicated by the dashed line 5''. This possible according to the invention due to the maintaining of the compactness of the bagasse throughout its passage through the present apparatus.

Incidentally, an open, screenless section F is considered to be present according to the invention if a conveying system including transport chains with entraining rods does not reduce the free, unobstructed surface area by more than about 20% of the total surface area forming such a section F.

The axial length L in the feed advance direction of the section F should relate to the diameter D of the upper roller 1 so as to satisfy the condition L/D shall not be smaller than 0.5. In other words, L/D should be larger or equal to 0.05.

The use of a free, open, unobstructed screenless section F is important for the removal of the substantial liquid quantity which becomes available at this point of the bagasse passage through the trough 9, especially when the trough 9 has a width of at least 2 mm. It has been found, that using this open, screenless section F according to the invention actually obviates the need for lateral screens in the side walls of the trough 9. This applys even for troughs having a substantial width in a direction perpendicularly to the plane of the drawing, for example in FIG. 1.

The horizontal spacing 7 according to the invention is important in its relation to the section F and with regard to the diameter of the squeezing roller 1 in order to assure the trouble-free initial squeezing-out and the final squeezing-out operation. It has been found that a spacing 7 is most efficient if the vertical segment 18 cut-off by the vertical chord line 17 extends into the zone or section F to an extent 19 between the vertical chord line 17 and a vertical tangent 17' to the roller 1. The vertical chord line 17 extends simultanously through the axis 15 of the roller 2 and through the downstream end of the section F, whereby the extent 19 corresponds to about 0 to 35% of the horizontal length L of the section F.

The relationship between the diameter D of the upper roller 1, in mm, to the depth D2 of the bagasse B upstream of the roller 6 should be smaller than 5.5.

Above it was mentioned that the roller 6 performs a triple function. Similarly, the upper pressure applying roller 1 also performs a triple function simultaneously. First, the roller 1 participiates in a portion of the initial squeezing out operation above the section F in the zone 5'. Second, the roller 1 performs the final squeezing out operation in cooperation with the counter roller 1 or the counter pressure member 3, primarily in the zone 7'. Third, the roller 1 operates as closing member for the trough 9 which is extended so that the side walls of the trough 9 reach downstream beyond the guide roller 10 for the conveyor 8. The side walls of the trough 9 may be constructed as lateral screens if desired. However, as stated above, according to the invention side screens are generally not necessary due to the provision of the open, screenless section F.

The diameter of the roller 1 and the total time t for the duration of the pressure application also provide an important relationship according to the invention. The diameter D of the upper roller 1 in mm to the total pressure application time t in seconds should be a constant value k 16.8. The pressure application time t corresponds to the sum of three sequential time durations $t1 \times t2 \times t3$ whereby t1 is the time for the dewatering, and t2 is the time for the preliminary or initial squeezing-out operation, and t3 is the time for the final squeezing out operation. These time durations are determined by the length of the respective zones 6', 5', 7' and the travelling speed of the bagasse through these zones. The total time t should be approximately 40 to 42 seconds, whereby the intermediate time t2 should correspond to about 25% of the total time.

The total pressure application time t is calculated on the basis of the speed of the bagase flow which is substantially equal to the output speed of the bagasse as it exits from a diffuser. The speed calculation takes further into account the horizontal distance between a point were the roller 6 becomes effective to the point of narrowest spacing between the rollers 1 and 2 or between the roller 1 and the counter pressure member 3'. Stated differently, each zone 6', 5', 7' or rather its horizontal length in the feed advance direction is taken into account when calculating the total pressure application time. In this connection it should be mentioned that the time during which the upper pressure or squeezing roller 1 is effective overlaps to some extent the time t2 because the roller 1 becomes effective in the zone 5' at a point in which the surface of the roller 1 intersects the horizontal line defined by the depth D2 of the bagasse.

Further, the pressure p applied by the roller 1 in $kg/cm^2$ should satisfy the relationship to the diameter D, in mm, of the roller 1 as follows d/0.6D shall be larger than 0.003. Stated differently, p should be larger than 0.0018 times D.

An important advantage and a further feature of the invention is seen in that the bagasse stream is used directly and without any further handling as it emerges from a diffuser. Thus, according to the invention the bagasse stream can be directly moved over the open screenless section F for the initial and final squeeze-out operation. No intermediate conveyors are necessary as shown in FIG. 3 of the prior art. This advantage has been accomplished by the above defined relationships. Thus, the invention obviates the peeling roller 28, the conveyors 29 and 37, and of course the high pressure mills, all as shown in FIG. 3. The invention also avoids the bagasse detour conduits which are required in the prior art in order to adapt the speed of the bagasse emerging from the diffuser to the high speed with which the bagasse moves through the high pressure mills of the prior art.

It has been found that the advantageous preliminary or initial squeezing out operation is primarily due to the cooperation of the two curved surfaces, namely, the rollers 1 and 2 in FIGS. 1 and 2. The continuous feed advance in combination with the bending of the bagasse flow in the zone 5' causes a displacement of the bagasse particles relative to each other as a result of a longitudinal shearing effect which is caused by the bending load on the bagasse flow in the zone 5' in combination with the feed advance force. Thus, the desired substantial liquid removal in the zone 5' is accomplished and such liquid removal is enhanced by the open, screenless section F. It has been found that a horizontal relative displacement of bagasse particles relative to each other of up to 300 mm may be accomplished if the two rollers 1 and 2 have each a diameter of about 4000 mm and if D2 corresponds to about 1500 mm. This displacement figure of 300 mm and more is based on a non-interrupted, continuous pressing operation.

Although the above disclosure refers primarily to a linear diffuser, it has been found, that the features of the invention may also be applied with advantage to a so-called circular or ring diffuser. In a linear diffuser the invention may be combined with such a linear diffuser by simply extending the side walls of the linear diffuser. In connection with a circular or ring diffuser a discharge trough may be arranged as a tangential extension of the circular diffuser walls. All the components described above may be located in such a tangential diffuser discharge trough in order to practice the present teaching. The open screenless section is realized in such an embodiment in that at the beginning of the tangential discharge chute the bagasse flow is lifted to a level above that of the screen bottom of the circular diffuser.

A further reduction of the remaining moisture content may be accomplished according to the invention by arranging several systems as shown in FIGS. 1 or 2 in series. In other words, the output bagasse B1 of a system shown in FIG. 1 may be introduced into a system shown in FIG. 2 and so forth.

Although the ivnention has been described with reference to specific example embodiments, it will be appreciated, that it is intended to cover all modifications and equivalents within the scope of the appended claims.

What is claimed is:

1. A method for reducing the liquid content of sugar cane bagasse, which has passed a diffuser for desugarizing, said method comprising the following steps:

(a) leading the bagasse as it exits from the diffuser at a bagasse travelling speed corresponding approximately to the exit speed of the bagasse from the diffuser said bagasse being in its compact diffuser exiting state and said bagasse being led from said diffuser into a liquid reducing apparatus through a feed advance path including an open screenless section (F), (b) causing in a first zone (6') of the feed advance path through which zone the bagasse passes during a first time period ($t_1$), a preliminary liquid removal from the advancing, compacted bagasse, by slightly further compacting the bagasse in said first zone (6') substantially adjacent to but still upstream of said open screenless path section (F) as viewed in the direction of feed advance, said first zone (6') having a first constant length whereby said first time period ($t_1$) is defined as:

$t_1$=(said first constant length)/(said given bagasse travelling speed), and whereby said liquid so removed from the bagasse passes substantially through said open screenless section (F), (c) causing in a second pressure increasing zone (5') through which the bagasse passed during a second time period ($t_2$), an initial squeezing-out of liquid from the bagasse downstream of said first zone (6') and substantially above said open screenless path section (F) for increasing an initial squeezing-out pressure to about 0.2 to 0.3 kg/cm$^2$ in said second zone (5'), said second zone (5') having a second constant length whereby said second time period ($t_2$) is defined as:

$t_2$=(said second constant length)/(said given bagasse travelling speed), (d) causing in a third pressure increasing zone (7') through which the bagasse passes during a third time period ($t_3$), a final squeezing-out of liquid from the bagasse downstream of said open screenless path section (F) thereby providing a final squeezing-out pressure (p) in said third zone (7') formed by at least one squeezing roller (1) having a diameter (D) such that the final squeezing-out pressure (p) in said third zone (7') is larger than 0.0018 times (D), whereby (p) is taken in kg/cm$^2$ and (D) is taken in millimeter, said third zone (7') having a third constant length whereby said third time period ($t_3$) is defined as:

$t_3$=(said third constant length)/(said given bagasse travelling speed), (e) selecting and providing the advancing speed of the bagasse so that the total time ($t=t_1+t_2+t_3$) of pressure application in said first (6'), second (5'), and third (7') zones satisfies the relationship $t>(D)/K$ wherein K is a constant, (D) is said diameter of the squeezing roller (1) in mm and t is in seconds; and (f) bending said stream of bagasse during its passage through said zones first downwardly and then upwardly to induce shearing forces within the bagasse for shifting bagasse particles relative to one another substantially in a feed direction or an opposite direction.

2. The method of claim 1, wherein said further compacting in said first zone (6') takes place at an average pressure of about 0.08 kg/cm$^2$ above a smooth surface portion (16).

3. The method of claim 2, wherein said further compacting is performed by means of a compacting roller (6) having a diameter (D1), said bagasse having a depth (D2) prior to said further compacting, whereby the ratio of D1 to D2 is smaller than or equal to 1.25.

4. The method of claim 3, wherein said compacting roller (6) is located so that its position in combination with the feed advance of the bagasse shifts the effective range of said compacting roller (6) outside of a screen bottom of said feed advance path toward said open, screenless section, whereby the liquid removed in step (b) passes substantially through said open, screenless section (F).

5. The method of claim 1, wherein said final squeezing-out pressure (p) is smaller than about 24 kg/cm$^2$.

6. The method of claim 1, wherein the steps (a) to (f) with the time and pressure limitations are repeated in one or more further liquid removal stages operatively arranged downstream of a liquid removal stage for performing said steps (a) to (f).

7. The method of claim 1, further comprising providing for said open, screenless section (F) a horizontal length (L) in mm in the feed advance direction which length (L) is larger than or equal to 0.05 times D, wherein (D) is the diameter of said sequeezing roller (1) in mm.

8. The method of claim 1, wherein the total time (t) of pressure application is selected to be within the range of about 40 to 42 seconds.

9. The method of claim 1, wherein about 48 to 50% by weight of the liquid in the bagasse is removed during said steps (b), (c), and (d).

10. The method of claim 1, wherein said second time period (t2) corresponds to about 25% of the total time (t).

11. The method of claim 3, further comprising selecting the ratio of (D), the diameter of said squeezing roller (1) in mm, to D2, the depth of the bagasse prior to the effect of the further compacting in mm, to satisfy the relationship D to D2 smaller than 5.5.

12. The method of claim 1, wherein the bagasse is directly supplied from an output of a diffuser into said liquid reducing apparatus whereby the bagasse flow remains substantially undisturbed.

* * * * *

UNITED STATES PATENT AND TRADEMARK OFFICE

CERTIFICATE OF CORRECTION

PATENT NO. : 4,452,641

DATED : June 5, 1984

INVENTOR(S) : Willy Kaether

It is certified that error appears in the above-identified patent and that said Letters Patent is hereby corrected as shown below:

IN "[57] ABSTRACT" line 18, delete "16".

IN "Column 5", line 21, replace "constant k value 16" by --constant value K--.

IN "Column 6", line 32, replace "apparaatus" by --apparatus--.

IN "Column 10", line 35, replace "secton" by --section--.

IN "Column 11", line 38, delete "16.8";
line 39, replace "t1Xt2Xt3" by --t1 + t2 + t3--;
line 41, delete "and";

IN the Claims, Column 13, line 25, replace "passed" by --passes--.
Column 14, line 38, replace "sequeezing" by --squeezing--.

Signed and Sealed this

*Fifth* Day of *March 1985*

[SEAL]

*Attest:*

DONALD J. QUIGG

*Attesting Officer* *Acting Commissioner of Patents and Trademarks*